US005409216A

United States Patent [19]

Brown

[11] Patent Number: 5,409,216

[45] Date of Patent: Apr. 25, 1995

[54] RACKET HANDLE

[75] Inventor: Andrew J. Brown, Cincinnati, Ohio

[73] Assignee: R.H. Associates, Ltd., Cincinnati, Ohio

[21] Appl. No.: 24,482

[22] Filed: Mar. 1, 1992

Related U.S. Application Data

[63] Continuation-in-part of Ser. No. 937,366, Aug. 28, 1992, abandoned, which is a continuation-in-part of Ser. No. 853,981, Mar. 20, 1992, abandoned, which is a continuation-in-part of Ser. No. 675,406, Mar. 21, 1991, abandoned, which is a continuation-in-part of Ser. No. 562,406, Aug. 2, 1990, abandoned, which is a continuation-in-part of Ser. No. 414,596, Sep. 27, 1989, abandoned, which is a continuation of Ser. No. 178,210, Apr. 6, 1988, abandoned, which is a continuation of Ser. No. 601,488, Apr. 18, 1984, abandoned.

[51] Int. Cl.[6] ..... A63B 49/08

[52] U.S. Cl. ..... 273/73 J; 273/81 C

[58] Field of Search ..... 273/735, 73 R, 80 R, 273/80 C, 75

[56] References Cited

U.S. PATENT DOCUMENTS

| | | | |
|---|---|---|---|
| 1,979,460 | 11/1934 | Forsberg . | |
| 3,545,755 | 12/1970 | Owada . | |
| 3,674,267 | 7/1972 | Hollis . | |
| 3,868,110 | 2/1975 | Jones . | |
| 3,905,598 | 9/1975 | Ballog . | |
| 3,995,856 | 12/1976 | Hollendorfer, Jr. . | |
| 4,006,896 | 2/1977 | Soldavini . | |
| 4,016,640 | 4/1977 | Briggs . | |
| 4,033,583 | 7/1977 | Ehrhart | 273/73 J X |
| 4,072,311 | 2/1978 | Bertucci . | |
| 4,072,312 | 2/1978 | Kahn . | |
| 4,101,125 | 7/1978 | Heath | 273/73 J X |
| 4,128,240 | 12/1978 | Berokoff . | |
| 4,147,348 | 4/1979 | Lee . | |
| 4,149,721 | 4/1979 | Strickland . | |
| 4,153,249 | 5/1979 | Plagenhoef . | |
| 4,183,528 | 1/1980 | An . | |
| 4,349,199 | 9/1982 | Vulcano | 273/73 J |
| 4,470,599 | 9/1984 | Usher, Jr. . | |
| 4,696,842 | 9/1987 | Doubt . | |
| 4,717,151 | 1/1988 | DuBois . | |
| 4,717,152 | 1/1988 | Kessler . | |
| 4,826,168 | 5/1989 | McGuire et al. | 273/81 C |
| 4,836,544 | 6/1989 | Lai . | |
| 4,854,596 | 8/1989 | Carbonetti | 273/73 J |
| 4,861,030 | 8/1989 | Burt . | |
| 4,943,058 | 7/1990 | Carbonetti | 273/73 J |
| 4,964,645 | 10/1990 | Lai . | |
| 5,018,734 | 5/1991 | Allsop | 273/73 J |
| 5,058,902 | 10/1991 | McCutchen . | |
| 5,133,553 | 7/1992 | Divnick . | |
| 5,158,287 | 10/1992 | Janes | 273/73 J |
| 5,169,145 | 12/1992 | Jang | 273/73 J |

FOREIGN PATENT DOCUMENTS

| | | | |
|---|---|---|---|
| 0360762 | 3/1990 | European Pat. Off. | 273/73 J |
| 1246701 | 10/1960 | France | 273/73 J |
| 2407725 | 6/1979 | France . | |
| 3200693 | 7/1983 | Germany | 273/75 |
| 3616414 | 11/1987 | Germany | 273/73 J |
| 3842126 | 8/1990 | Germany . | |

*Primary Examiner*—William E. Stoll

*Attorney, Agent, or Firm*—Willian Brinks Hofer Gilson & Lione

[57] ABSTRACT

A racket having a handle with a substantially planar striking surface, a neck having one end connected to the substantially planar striking surface. The racket further comprising a handle connected to another end of the neck, wherein the handle is rotatable about an axis to one or more predetermined positions.

6 Claims, 7 Drawing Sheets

10

10

112
113
114
116
118
120
122
124
126
128
130
132
134
136
138
140
5
6
8
10

RACKET HANDLE

CROSS REFERENCE

This is a continuation-in-part application of my application Ser. No. 07/937,366 filed Aug. 28, 1992 entitled "Racket Handle" now abandoned, which is a continuation-in-part application of my application Ser. No. 07/853,981 filed Mar. 20, 1992 entitled "Racket Handle", now abandoned which is a continuation-in-part application of my application Ser. No. 07/675,406 filed Mar. 21, 1991 entitled "Racket Handle", now abandoned, which is a continuation-in-part of Ser. No. 562,406 filed Aug. 2, 1990 entitled "Racket Handle", now abandoned which is a continuation of Ser. No. 414,596 filed Sep. 27, 1989 entitled "Racket Handle" which has been abandoned, which was a continuation of Ser. No. 178,210 filed Apr. 6, 1988 entitled "Racket Handle", now abandoned, which was a continuation of Ser. No. 601,488 filed Apr. 18, 1984, entitled "Racket Handle" which has been abandoned. The disclosures of each of the above-mentioned applications are incorporated herein by reference.

BACKGROUND OF THE INVENTION

Field of the Invention

This invention relates generally to rackets and handles therefor and, more particularly, concerns tennis rackets in which the correct orientation of a player's grip on the racket handle is facilitated by the shape of the handle.

Background Art

In the play of tennis, a tennis racket is generally gripped in a different fashion for a forehand stroke than for a backhand stroke. If the tennis racket is properly gripped for each of these strokes, the ball is struck by the head of the racket with the ball-contacting surface of the head oriented so that a proper trajectory of the ball results. In such a case the ball-contacting surface, defined by the racket strings, is generally, though not necessarily exactly, perpendicular to the ground at the point of impact with the tennis ball.

In order to obtain the proper racket orientation in the player's hand, the player typically relies upon the feel of the racket handle to position the handle relative to the player's palm, fingers, and thumb. It is generally impractical for the player to actually view the orientation of the racket in the player's hand in the course of play due to the speed with which the correct grip, forehand or backhand, must be selected, while the player also establishes proper position for striking the ball.

In the construction of a typical tennis racket, the handle is symmetrical, when viewed in endwise cross-section, about the plane of the striking surface of the racket head. Often the handle is also symmetrical about a plane perpendicular to the plane of the racket head. In such racket handles, the principal, or longest, surfaces of the handle are generally either parallel or perpendicular to the plane of the strings of the head of the racket. Consequently, in order to effect the proper grip, whether forehand or backhand, on the racket handle, the player must, by sense of feel, locate the appropriate major surface to be engaged by the hand and, by rotation of the racket handle in the hand, arrive at the desired orientation of these surfaces in hand.

The principal "feel38 of the racket handle is obtained by the contact of the palm, fingers, and thumb of the player's hand with the major surfaces of the racket handle. In gripping a typical tennis racket handle, the exact location of, for example, a major surface of the racket handle within the palm of the hand may be readily obtainable for an expert tennis player. However, obtaining this proper handle orientation is much more difficult for a less experienced player. Since even a relatively small degree of misorientation of the racket in the player's hand can result in an improper trajectory for the ball, inaccuracies in a player's grip can have a greatly adverse effect upon the player's game.

Traditionally, tennis players have used the "Eastern grip" for grasping the tennis racket. The Eastern grip is obtained by "shaking hands" with the racket. In other words, the player's palm is placed flush against the handle's widest surface. Most players using an Eastern grip will have the racket head several degrees from vertical when striking a tennis ball. This is because players are taught to strike a ball as if they are striking with their hand vertical and when an Eastern grip is used most players will align the racket head several degrees from vertical. However, when the racket head is vertical or very close to vertical at the point of impact the most consistently accurate tennis shots can be made.

When using the Eastern grip most players find it necessary to rotate the racket handle in the hand to execute a backhand stroke. As a player changes from a forehand stroke to a backhand stroke, therefore, the racket must be continuously realigned, increasing the possibility of misalignment when striking a ball.

Many players who are gripping a typical tennis racket using an Eastern grip will compensate for the upwards orientation of the racket head by providing a rapid rotation (pronation) of the forearm as they swing through a ball to keep from hitting the ball off the court. This rapid pronation places unnecessary stress on the forearm prior to and after impact and has been known to lead to several types of elbow injury.

Recently, some top players have been rotating the traditional tennis racket grip a quarter turn to allow them to more consistently strike the ball with the racket head in a vertical alignment. This grip is called the "semi-Western" grip. In this way, it becomes easier for some players to accurately deliver a shot and to hit "over" the ball to produce a top spin, thus improving the quality of the player's game.

Using a traditional racket handle rotated in the player's hand to effect the semi-Western grip is difficult because, as discussed above, it is hard for players to feel when the racket head is properly aligned. In addition, when a ball is off center there is a tendency for the racket to twist from a proper alignment in the player's hand because no surface of the racket is flush with the player's palm.

In the past, various types of racket handles have been proposed which include such features as special contours, or finger and thumb-receiving grooves, for assisting in orienting a player's hand on the racket handle. Such proposed handles have been formed more or less in the shape of "pistol grips" and the like. Such grips, while they permit better orientation of the hand on a racket handle, have been found objectionable because they lack the "feel" of a conventional tennis racket handle to which players have become accustomed. In addition, such "pistol grip" types of formed racket handles often fail to provide proper hand orientation for both forehand and backhand grips. In most cases, such rackets must be custom made for each individual player, which greatly adds to the cost of the racket.

SUMMARY OF THE INVENTION

It is consequently the general aim of the present invention to provide a tennis racket handle which can be easily and accurately positioned in a player's hand for either a forehand or a backhand stroke, and with which the "feel" of a conventional racket handle is retained. Also, an aim of the present invention is to provide a racket handle that facilitates proper alignment of the racket head in delivering either a forehand or backhand shot without rotating the handle. In addition, an aim of the present invention is to provide a tennis racket handle that facilitates a vertical alignment of the racket head as a tennis ball is struck to provide a more accurate shot. A further aim of the present invention is to provide a racket handle that aligns the racket as a natural extension of the skeletal structure of the human arm, i.e., which aligns the racket head parallel to the position of a player's hand when a ball is struck, and in which this alignment is vertical. An additional aim of the present invention is to provide a tennis racket handle that aligns the racket head with the palm of a player's hand in an anatomically correct position which decreases the stress on the player's forearm and elbow as the player swings through a ball. In other words, the present invention is adjustable to take into account a player's natural aim so that when a player strikes a ball the striking surface is in a vertical position.

These objectives have been accomplished in accordance with certain principles of the invention by the provision of a tennis racket having a handle with a substantially planar striking surface, a neck having one end connected to the substantially planar striking surface. The racket further comprising a handle connected to another end of the neck, wherein the handle is rotatable about an axis to one or more predetermined positions.

BRIEF DESCRIPTION OF THE DRAWINGS

Other objects and advantages of the invention, and the manner of their implementation, will become apparent upon reading the following detailed description and upon reference to the drawings, in which.

DETAILED DESCRIPTION OF THE DRAWINGS

Figure 1:
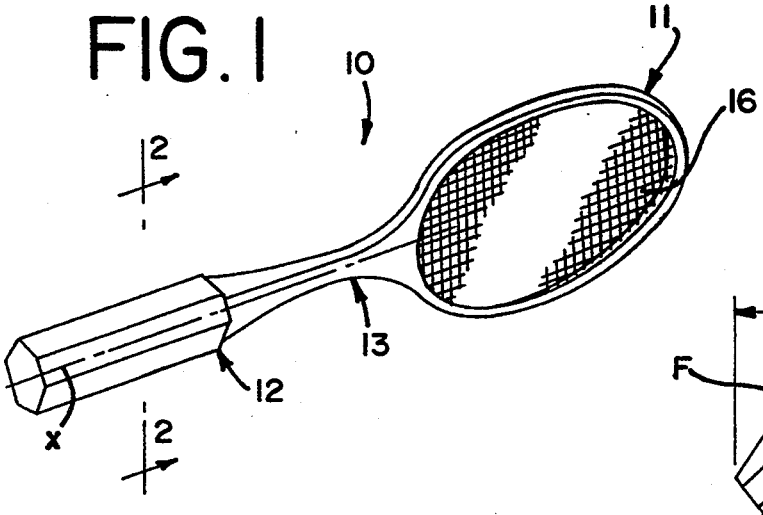
FIG. 1 is a perspective view of a tennis racket having a head portion and a handle portion constructed in accordance with the present invention.

While the invention is susceptible to various modifications and alternative forms, certain illustrative embodiments thereof have been shown by way of example in the drawings and will herein be described in detail. It should be understood, however, that the invention is not intended to be limited to the particular forms disclosed, but, on the contrary, the invention is to cover all modifications, equivalents, and alternatives falling within the spirit and scope of the invention as defined by the appended claims.

Figure 2:
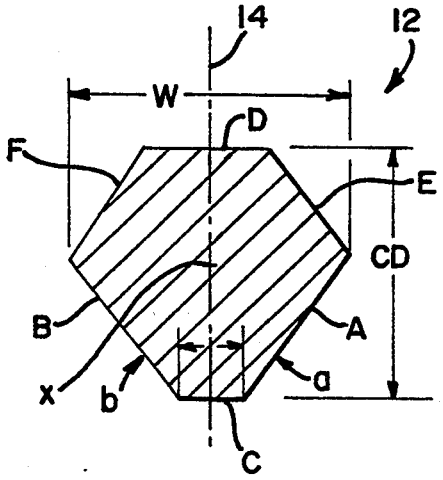
FIG. 2 is a cross-sectional view of the handle of FIG. 1 taken along the line 2—2 and in the direction of the arrows.

Turning now to the figures, a tennis racket 10 includes a head portion 11 and a handle portion 12 joined by a neck portion 13. The particular construction of the head 11 and the neck 13, and the internal construction of the handle 12, are not critical to the practice of the present invention. As best shown in FIG. 2, the perimeter of the handle 12 is made up of six faces, identified A through F. The six surfaces are contiguous with each other, i.e., F is contiguous with D and B, etc. However, the corners at the juncture of any two contiguous surfaces might be altered, i.e., slightly rounded, flattened, without departing from the invention. In other words, A is adjacent to E and C and C is adjacent to A and B, etc. The surfaces A through F preferably are shown to have the same dimensions lengthwise of the handle portion 12 so that each surface is substantially rectangular, however, that is not necessary. The width of the surfaces may vary. Viewed in cross section, the handle is symmetrical about a plane 14 of the striking surface of the head 11 of the racket 10, which may be regarded as a plane in the center of the strings 16 in the racket head 11. That is, the cross section of the handle on opposite sides of the plane 14 is a mirror image of itself. The plane 14 coincides with a center line X for the racket extending through both the head portion 11 and handle portion 12 in the embodiment shown. The central axis of the handle portion 12 need not, however, extend through the center of the head portion 11, as where the handle is offset or is slightly angled with respect to the plane of the ball striking surface. For simplification the strings 16 can be viewed as defining a plane with oppositely facing striking surfaces.

Figure 12A:
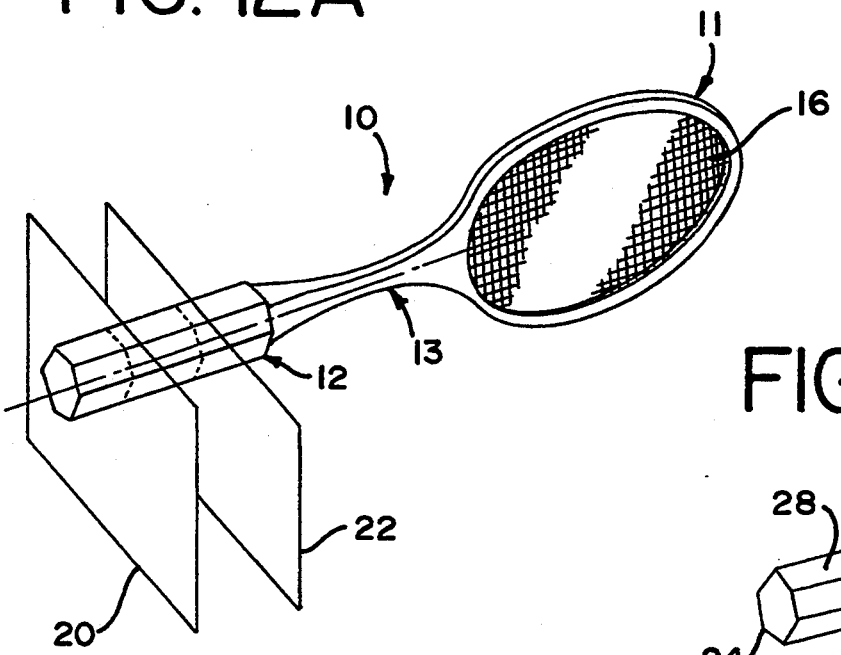
FIGS. 12*a* and 12*b* are perspective views of a section of the handle of FIG. 2 which is in the shape of a prism.
Figure 12B:
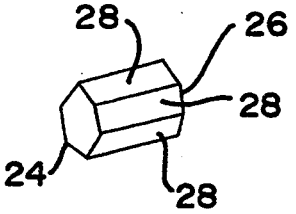

Another way of describing the handle is shown in FIG. 12*a* in which the handle has two parallel planes 20 and 22, which are perpendicular to the plane of the striking surface 14, intersect the handle 12 (dashed lines). Upon their intersection the planes 20, 22 and the handle 12 define a prism having two polygonal bases 24 and 26 and a plurality of rectangular surfaces 28 as shown in FIG. 12*b*. As will be seen in the Figures it is preferred that at least one of the plurality of rectangular surfaces 28 or sides of the polygonal bases 24 and 26 defines with a plane parallel to the plane of the striking surface an angle ranging from approximately 25° to 40°. Though the description to follow will define the handle with respect to the surfaces, it should be understood that any description of the length of the surfaces is applicable to corresponding sides of the polygonal bases 24 and 26. Thus, a lengthening of surface A would correspond to a lengthening of a corresponding side A of each polygonal base 24, 26. In the illustrated racket handle 12, the six handle surfaces include two longest, or major, surfaces A and B, two minor surfaces C and D, and two intermediate surfaces E and F. In the illustrated form of the invention, the minor surfaces C and D are perpendicular to the plane 14, and in the illustrated handle the surfaces D, E and F are equal in length, as viewed in the cross section of FIG. 2. The illustrated major surfaces A and B are also equal in length, as viewed in FIG. 2, and form equal angles "a" and "b" with planes parallel to the ball-striking plane 14. The angles 37 a" and "b" are between 25° and 40°, and preferably lie in the range of 29° to 37°. Preferably, surfaces E and F are parallel to surfaces B and A respectively throughout the entire contemplated range of angles for "a" and "b", i.e. DE and DF range between 115° and 130°, however this is not absolutely necessary. For angles for "a" and "b" within the range of 25° and 40°, it is presently believed that proper forehand and backhand grips on the racket, in a manner to be discussed, can be obtained by players having a range of forms in striking the ball. In rackets thus far constructed, it has been found that for some people the angles "a" and "b" are between 31° and 36°. However, the angles "a" and "b" may vary greatly depending on the individual. In the illustrated racket handle, the angles "a" and "b" are 34°.

In the cross section of FIG. 2, the handle 12 has two principal dimensions. The first is the distance between the minor surfaces C and D, indicated CD in the figure. The second principal dimension is the distance between the intersection points AE and BF, indicated W in the figure. In the illustrated form of the invention, the distance W is preferably greater than or equal to the distance CD.

Figure 3A:
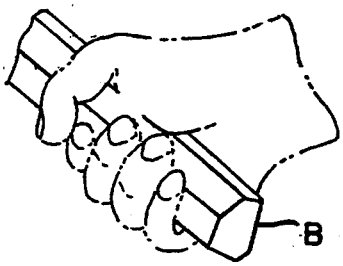
FIGS. 3*a* and 3*b* are perspective views of a portion of the tennis racket handle showing a forehand grip thereon.
Figure 3B:
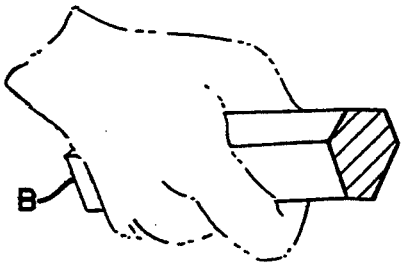

A right-handed player grips the racket 10 for a forehand stroke as shown in FIGS. 3*a* and 3*b*. In the forehand grip illustrated, for a right-handed player, the palm of the hand engages the major surface B of the handle 12. The thumb grasps the handle about the surfaces F and D, with the tip of the thumb extending onto the surface E. The bases of the fingers contact the surface C, with the fingertips extending about the handle into contact with the surfaces E and D. The fingers encircle the surface A, without significantly contacting the surface.

The principal gripping force on the racket is exerted between the surfaces B and E, with the spacing between these surfaces cooperating with the arrangement of the other faces to produce the "feel" of a conventional tennis racket handle. The handle of the racket face is ensured to be substantially correct due to the angle "b" of the major surface B with the ball-contacting plane 14 of the racket face. The relative size of the surface B results in the accurate orientation of the racket in the player's hand to produce the proper orientation of the racket head when the ball is struck.

Figure 4A:
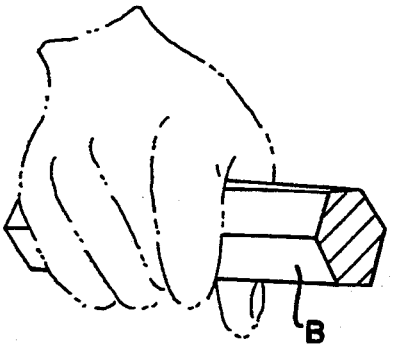
FIGS. 4*a* and 4*b* are perspective views of the handle portion of FIGS. 3*a* and 3*b* showing a backhand grip thereon.
Figure 4B:
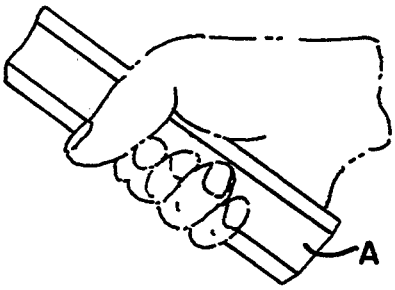

To grip the handle for a backhand stroke, the racket handle may be grasped as shown in FIGS. 4*a* and 4*b*. For a backhand stroke, by a right-handed player, the palm of the hand engages the surfaces D and E, with the thumb extending along the surface A. The bases of the fingers lie along the surface F, and the fingers extend around the surface B, without significant contact thereon, with the fingertips engaging the surface C and extending partially onto the surface A. The primary grasping force for the backhand stroke is exerted between (a) the surfaces D and E and (b) the surface C. Due to the spacing between these surfaces, and the contour of the other surfaces, the "feel" of the racket in the backhand grip is similar to that of a conventional racket.

Alternatively, when using the handle of the present invention a player may deliver a backhand stroke with the racket head properly aligned by grasping the racket as illustrated in FIGS. 3A and 3B, i.e., without rotating the racket handle.

The forehand and backhand grips for the racket 12, for a left-handed player, are analogous to those illustrated for a right-handed player. For a forehand grip, for example, a left-handed player grasps the racket handle 12 with the player's palm engaging the surface A. For a backhand stroke, the palm-engaging surfaces are the surfaces D and F, or as discussed above, may be identical to the forehand grip.

The perimeter dimension of the handle 12 may be increased or decreased, preferably while maintaining the relative proportions of the handle surfaces, to properly size the handle dependent upon the size of the hand of the player. In this way, a racket handle of the configuration shown may be provided wherein the palm, fingers and thumb of any size hand lie on the requisite surfaces, as set forth above.

While only a single preferred embodiment of the present invention has thus far been described, those persons skilled in the art to which the invention pertains will readily appreciate that changes and modifications may be made without departing from the spirit of the invention. For example, the intermediate surfaces E and F and the minor surface D need not be of the same length, as viewed in the cross-sectional view of FIG. 2. As another example, the end of the handle may be of an enlarged cross-section relative to the remainder of the handle to reduce the tendency of the handle to slide from the player's grasp during play.

It has been found, as a further example, that the major surfaces A and B (as shown in FIG. 2) can be more easily located by making these surfaces slightly larger. This can facilitate obtaining a proper grip upon the racket handle.

Figure 5A:
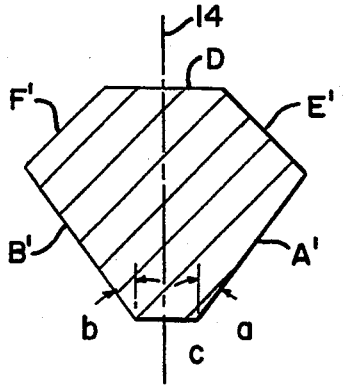
FIGS. 5*a*–5*c* are cross-sectional views of modified forms of handle construction according to the present invention.

As shown in FIG. 5, the major surfaces A′ and B′ are lengthened, and the intermediate surfaces E′ and F′ are slightly shortened (relative to the surfaces A, B, E and F of FIG. 2). The lengths of the minor surfaces C and D remain the same, and the angles "a" and "b" remain the same, as those shown in the handle of FIG. 2.

Figure 5B:
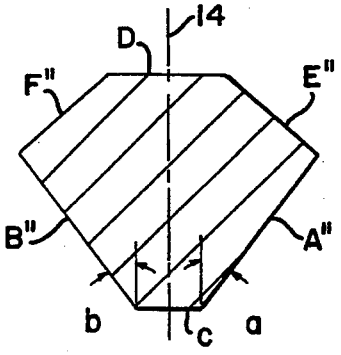
Figure 5C:
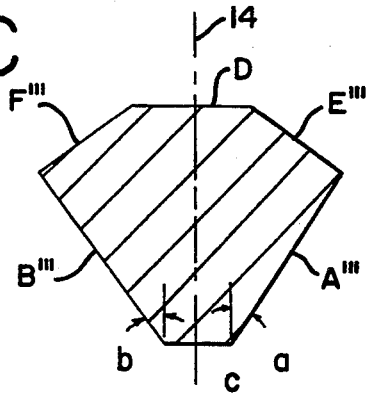

In the handle of FIG. 2, the angles DF and DE are about 124°. In the handles illustrated in FIGS. 5*a*, 5*b* and 5*c*, these angles are increased, with resultant lengthening of the surfaces A′ and B′ (FIG. 5*a*), A″ and B″ (FIG. 5*b*), and A‴ and B″ (FIG. 5*c*), In FIG. 5*a* the angles DF′ and DE′ are about 135°. In FIG. 5*b* the angles DF″ and DE″ are about 140½°, and in FIG. 5*c* the angles DF‴ and DE″ are about 146°. The invention also contemplates all angles between 124° and 146°.

Figure 6:
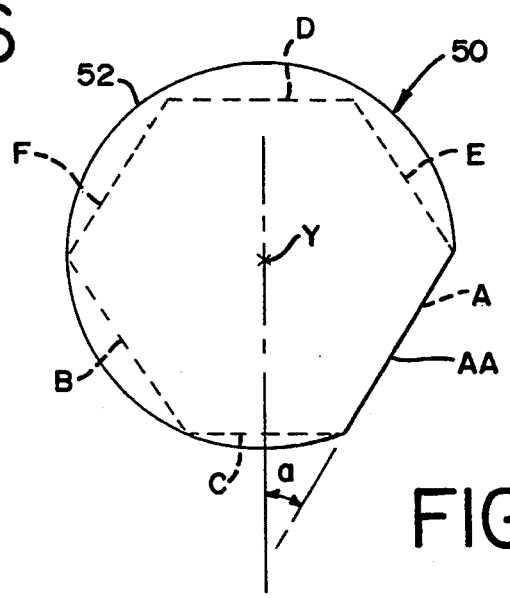

Further modified forms of handle construction according to the present invention are depicted in FIGS. 6–9. In FIG. 6, a simplified version of the inventive handle is shown at 50 designed for a right-handed individual. The handle portion 50 has an overall cylindrical shape with a central axis Y and a flat side AA. Another way of describing the handle is to have two parallel planes, which are perpendicular to the planar striking surface, intersect the handle 12 in a manner similar to that shown in FIG. 12*a*. The planes and the handle define a cylinder-like solid comprising two bases with a curved surface and a planar rectangular surface joining the two bases. As seen in FIG. 6, the rectangular planar surface AA defines with a plane parallel to the planar striking surface an angle "a" ranging from approximately 25° to 40°. The similarities between the handle portion in FIG. 6 and that in FIG. 2 are demonstrated by illustrating the handle portion 50 circumscribed around a phantom representation of the FIG. 2 handle. The angle "a", as in the prior embodiments, ranges preferably between 25°–40°.

Figure 7:
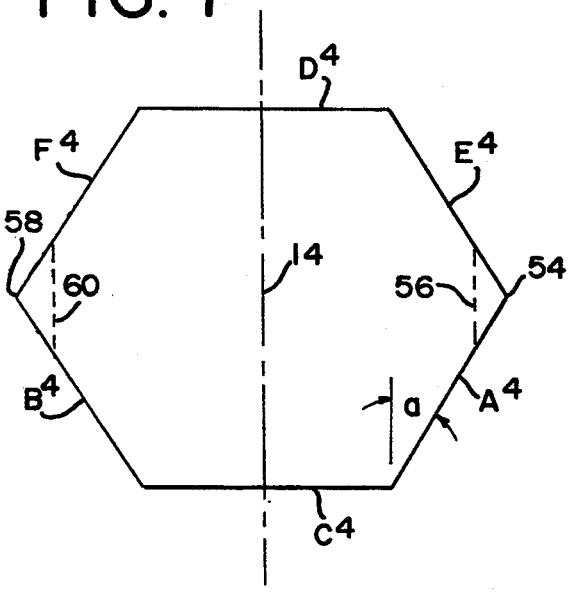

In FIG. 7, a handle portion is shown having a configuration similar to that of the handle in FIG. 2 and corresponding sides $A^4$–$F^4$. One of the differences between the FIG. 2 and FIG. 7 handles is that the surface $C^4$, corresponding to surface C, is equal in length to the surface $D^4$ corresponding to the surface D in FIG. 2. Further, the handle in FIG. 7 has three oppositely facing or diametrically opposed pairs of parallel sides —$A^4$, $F^4$; $B^4$, $E^4$; and $C^4$, $D^4$. The lengths of sides $A^4$, $B^4$, $E^4$ and $F^4$ are approximately the same and less than the lengths of $C^4$ and $D^4$.

The surfaces $E^4$ and $A^4$ meet either at a point 54, as shown in solid lines in FIG. 7, or alternatively are connected by flat surface 56, shown in phantom. On the opposite side of the FIG. 7 handle portion, surfaces $B^4$, $F^4$, meet either at a point 58, as shown in solid lines in FIG. 7, or are connected by a flat surface 60.

Figure 8:
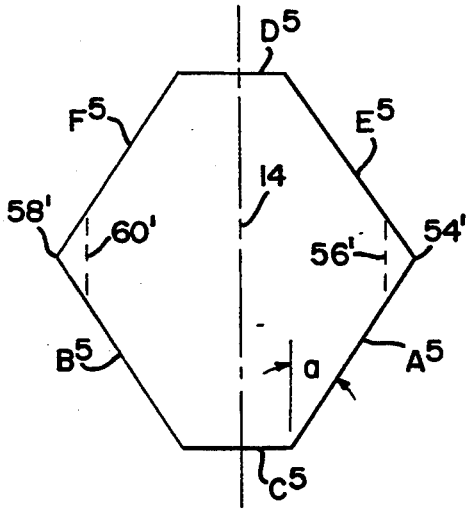

In FIG. 8, a handle is shown similar to that in FIG. 7 with the difference being that surfaces $C^5$ and $D^5$, corresponding to $C^4$ and $D^4$ in FIG. 7, are of the same length and shorter than surfaces $A^5$, $B^5$, $E^5$ and $F^5$, all of which are of equal length. The handle surfaces $A^5$, $E^5$ and $B^5$, $F^5$ in FIG. 8 meet each other at apexes 54′, 58′, respectively, or are joined to each other by surfaces 56′, 60′, corresponding to surfaces 56, 60 in FIG. 7.

Figure 9:
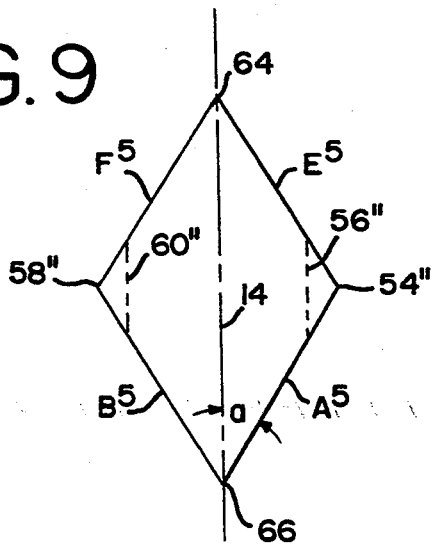

In FIG. 9, a handle is shown similar to that in FIGS. 7 and 8, however, surfaces corresponding to $C^4$, $D^4$, $C^4$, and $D^5$ have been eliminated. The surfaces $E^5$, $F^5$ in FIG. 9 directly connect at apex 64 while surfaces $A^5$, $B^5$, meet at apex 66. The handle in FIG. 9 may have surfaces shown in phantom at 56″, 60″ to connect surfaces $E^5$, $A^5$, and $B^5$, $F^5$, respectively, to eliminate apexes 54″ and 58″.

In the embodiments for the inventive handle shown in FIGS. 7–9, the angle "a" makes an angle preferably between 25°–40° with the plane 14 of the striking surface of the head 11 of the racket 10.

Figure 10:
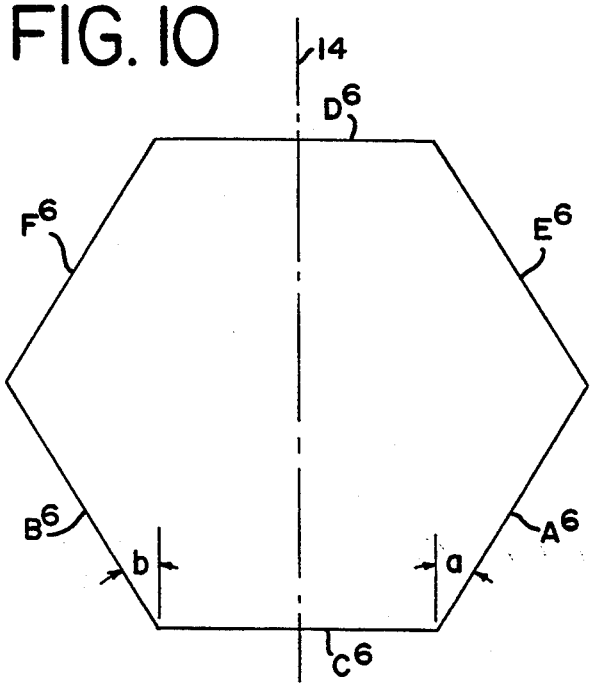
FIGS. 6–11 are cross-sectional views of other modified forms of handle construction according to the present invention.

In FIG. 10, the handle portion is shown having a configuration similar to that of the handle in FIG. 7 and with corresponding sides $A^6$–$F^8$. The principle difference between FIG. 7 and FIG. 10 is that the surfaces $A^6$–$F^6$ corresponding to surfaces $A^4$–$F^4$ are substantially equal in length to each other. In addition, the planes formed by surfaces $D^6$ and $C^6$ are substantially perpendicular to the ball-contacting plane 14 of the racket face. Finally, the angles "a" and "b" make an angle of about 25° to 40° with the plane 14 of the striking surface of the head 11 of the racket 10. An angle of about 33° is preferred. The angles $D^6F^6$, $D^6E^6$, $B^6C^6$, $C^6A^6$, $E^6A^6$ and $F^6B^6$ may be any angle between about 125° and 110°. In the embodiment of FIG. 10, the angles $D^6F^6$, $D^6E^6$, $B^6C^6$ and $C^6A^6$ are preferably about 123° and the angles $E^6A^6$ and $F^6B^6$ are about 114°.

Figure 11:
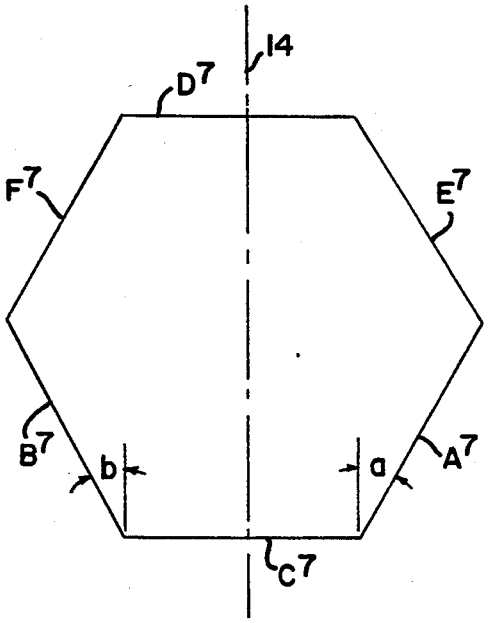
Figure 13:
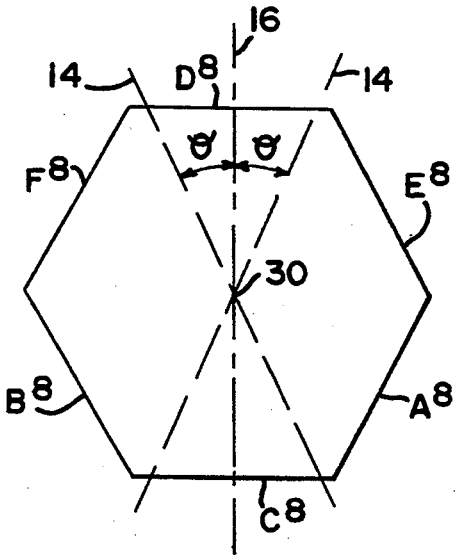
FIG. 13 is a cross-sectional view of a handle construction which is asymmetric with respect to the planar striking surface.

In FIG. 11, the handle portion is shown with a configuration similar to FIG. 10 and with corresponding sides $A^7$–$F^7$. In FIG. 11 the angles $D^7F^7$, $D^7E^7$, $B^7C^7$, $C^7A^7$, $E^7A^7$ and $F^7B^7$ are all equal to 120° and the sides $A^7$–$F^7$ are equal width. Thus, the cross-section of the handle of FIG. 11 is a regular hexagon. When the surfaces D and E are perpendicular to the plane of the racket head as shown in FIG. 11, the angles a and b are 30°. The angle "a" may be between about 25° and 40°, which of course would cause the surfaces D and C to not be perpendicular to the ball striking surface (except when a and b are exactly 30°) and resulting to the prism-shaped handle being asymmetric with respect to a plane parallel to the planar striking surface. As seen in FIG. 13, having the angle "a" ranging between about 25° and 45° results in the plane of the striking surface 14 forming an angle ($\theta$) between the plane 14 and a plane of symmetry 16 which ranges from approximately −5° to approximately 10°, wherein a negative angle denotes that plane 14 intersects side D to the right of the plane of symmetry 16 and a positive angle denotes intersection to the left of the plane 16.

It has been discovered that for a prism-shaped handle improved "feel" and orientation are achieved when the prism-shaped handle is asymmetric with respect to a first plane parallel to or defined by the planar striking surface. This is illustrated in FIG. 13 where the orientation between a regular hexagon and the plane 14 defined by the planar striking surface is shown. The plane 14 of the striking surface preferably intersects the center 30 of the regular hexagon, but may also be displaced from the center 30. The plane 14 of the striking surface is angled with respect to a second plane 16 defines a plane of symmetry for the prism-shaped handle and preferably bisects and is perpendicular to the two parallel sides $C^8$ and $D^8$. The acute angle ($\theta$) between the planes 14 and 16, measured from either the left or right of plane 16, ranges from greater than 0° to approximately 40° and preferably ranges from greater than 0° to approximately 30°, thus including ranges from greater than 0° to approximately 10° and from greater than 0° to approximately 5°. Similarly, it is also contemplated that the plane of the striking surface and a plane of symmetry for the regular hexagon inscribed by the cylinder-like handle of FIG. 6 define an angle ranging from greater than 0° to approximately 40° and preferably from greater than 0° to approximately 30°.

Furthermore, improved "feel" and orientation are achieved when a first plane parallel to or defined by the planar striking surface is at an angle with respect to a molded handle having a molding conforming to the shape of a player's hand. Examples of such molded handles are well known, for example, U.S. Pat. Nos. 3,868,110; 3,905,598; 4,006,896; and 4,147,348 each of whose disclosures are incorporated herein by reference. In prior art molded handles, the plane of the striking surface 16 is aligned with a plane 70 bisecting the "V" formed between the thumb and the fingers 72 of a player when properly positioned on the molded handle 74, as seen with the prior art racket disclosed in FIGS. 14*a–b*. However, according to the present invention a better "feel" and orientation is accomplished when a first plane 16 parallel to or defined by the planar striking surface of the racket is not aligned with but is at an acute angle ($\theta$) with respect to the plane 70 bisecting the "V" formed between the thumb and the fingers 72 of a player properly positioned on the molded handle 74.

Figure 14C:
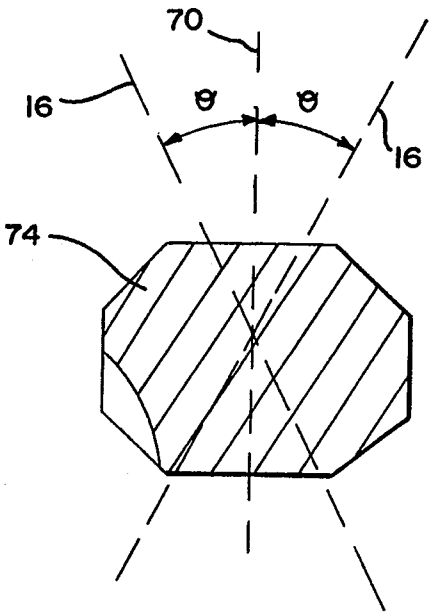
FIG. 14*c* is an end view of an embodiment of the present invention which employs the molded handle of FIGS. 14*a*–*b* and wherein the plane of the striking surface is at a nonzero angle with respect to the plane formed by the "V" of a player's hand.
Figure 14B:
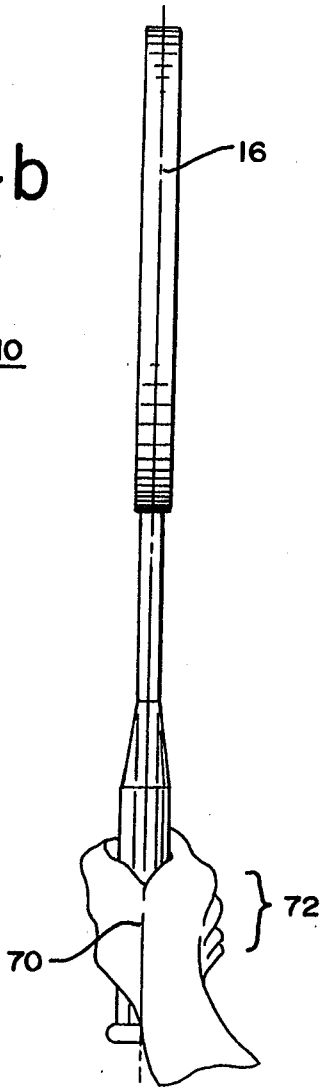
FIG. 14b PRIOR ART
FIGS. 14*a*–*b* are perspective views of a prior art racket with a molded handle.
Figure 14A:
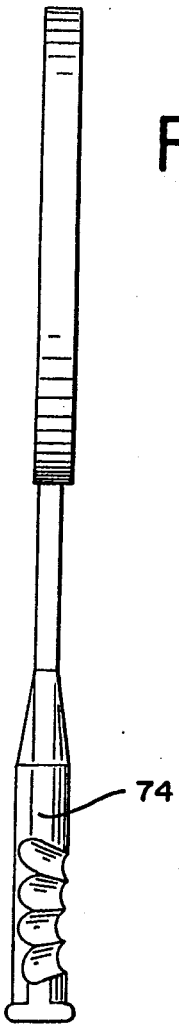
FIG. 14a PRIOR ART

An embodiment of the present invention is illustrated in FIG. 14*c*, wherein an end view of a molded handle 74, corresponding to the handle of FIG. 14*a*, is shown and the plane 16 of the striking surface and the plane formed by the "V" are illustrated. The acute angle ($\theta$) between the planes, measured from either the left or right of the plane bisecting the "V", ranges from greater than 0° to approximately 40° and preferably ranges from greater than 0° to approximately 30°, thus including ranges from greater than 0° to approximately 10° and from greater than 0° to approximately 5°.

The racket handle of the present invention is a significant improvement over traditional racket handles in that, when the plane of the striking surface defines an acute angle ranging from greater than 0° to approximately 40° with respect to a plane bisecting the "V" formed by the hand. The handle therefore facilitates a grip which aligns the racket as a natural extension of the skeletal structure of the human arm with the racket head parallel to the position of a player's hand when a ball is struck, i.e., with the racket head vertical. By facilitating a natural alignment of the racket face to the hand and a vertical orientation of the racket head when a tennis ball is struck, the consistency and accuracy of tennis strokes are improved. Moreover, this orientation reduces the stress on many players' forearms and elbows which results from trying to properly align the racket head using an Eastern grip.

The racket handle illustrated in FIG. 2 has been found particularly advantageous for use by the general population. Tests conducted by two major research universities have indicted that using a tennis racket handle of the present invention which aligns the palm of the player's hand at about a 33° angle from the plane of the racket head provides a significant improvement in the play of most novice players. Indeed, tests conducted by these institutions have shown that between 50% and 80% of tennis players will have an improved racket head alignment using such handles.

The improvement in such a large percentage of the tennis playing population could have a significant impact on the tennis industry. One report estimates that there are approximately 10 million casual players and 20 to 30 million ex-players in the United States alone. Improving the play of this population undoubtedly will increase their interest in the game and lead to a corresponding increase in the sale of tennis rackets and other tennis equipment.

Figures 15, 16, 17:
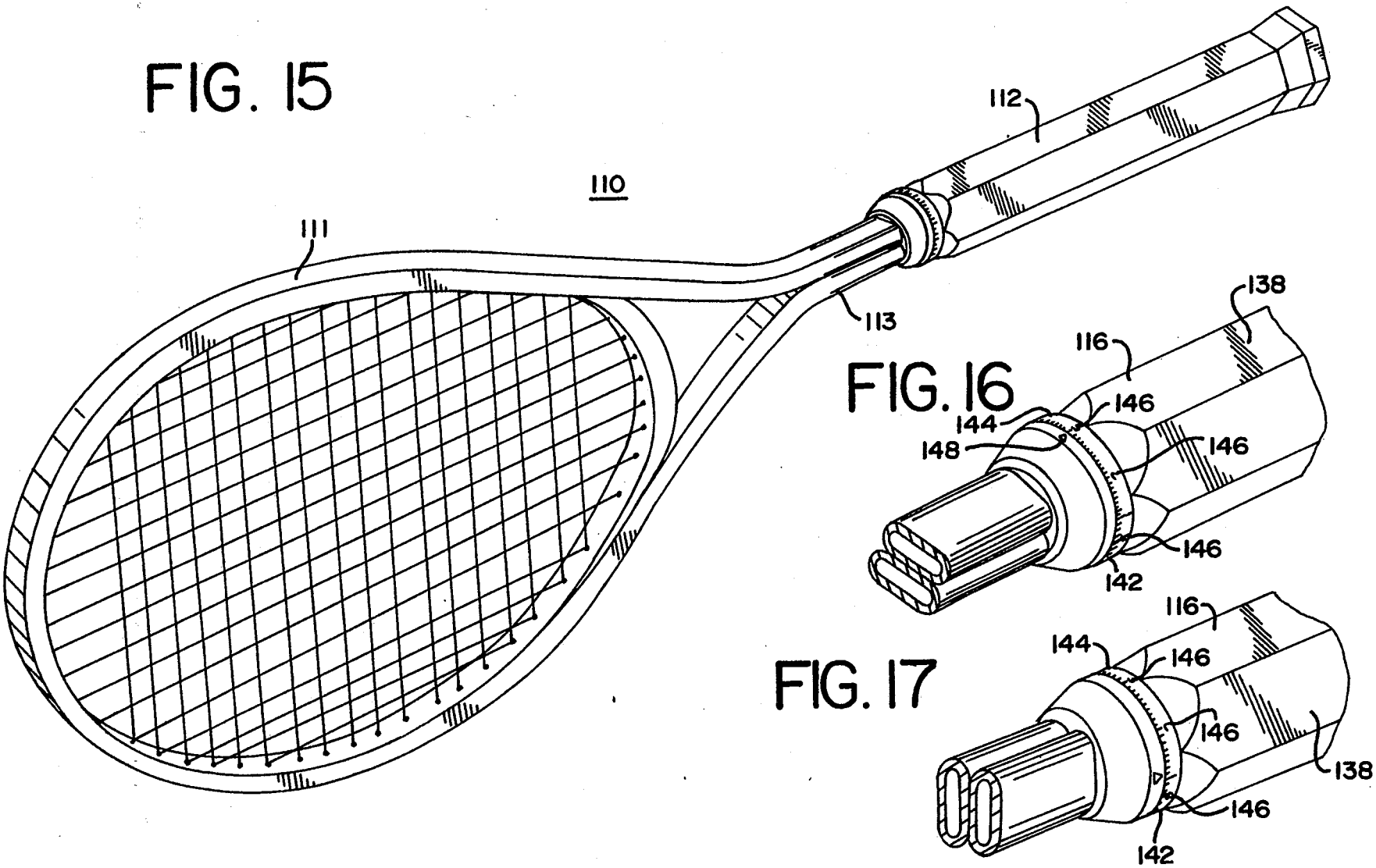
FIG. 15 is a side view of an embodiment of the present invention which employs a rotatable handle.
FIGS. 16 and 17 are cut-away views of the neck when the handle of the embodiment of FIG. 15 is rotated to various positions.

Another embodiment of the invention is shown in FIGS. 15–24. In particular, FIG. 15 shows a racket 110 with a head portion 111 having a substantially planar striking surface attached to one end of a neck portion 113 and the other end of the neck portion 113 is connected to a rotatable handle 112 capable of being rotated about an axis to one or more predetermined positions. The handle is rotated to a position such that the handle is asymmetric with respect to a first plane parallel to or defined by the planar striking surface in a manner similar to that shown in FIG. 13. The amount of rotation of the handle 112 is determined by how much an individual player's grip misaligns the racket head with respect to vertical. Thus, for example, if it is determined with a person holding a normal racket that the racket head is misaligned by 30°, one rotates handle 112 by 30° so that a plane defined by the planar striking surface is at an angle 30° with respect to a side of the handle 112.

Figures 18, 19, 20, 21, 22, 23, 24:
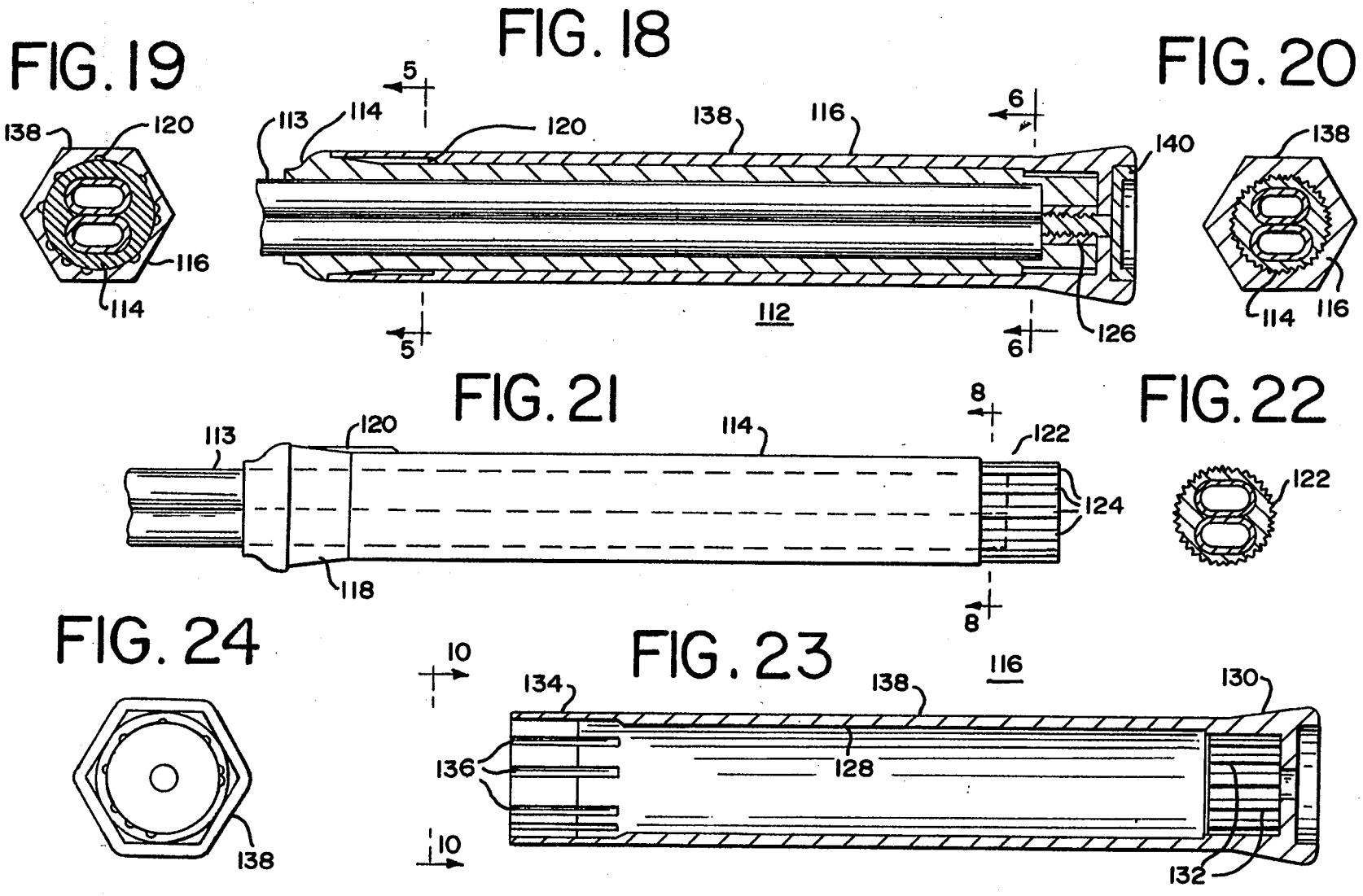
FIG. 18 is a side-sectional view of the embodiment of the handle of FIG. 15.
FIGS. 19–20 are cross-sectional views along lines 5—5, 6—6, respectively of the embodiment of the handle of FIGS. 15 and 18.
FIG. 21 is a side view of an embodiment of the core of the embodiment of the handle of FIGS. 15 and 18.
FIG. 22 is a cross-sectional view along line 8—8 of the embodiment of the core of the handle of FIG. 21.
FIG. 23 is a side-sectional view of an embodiment of the sheath of the embodiment of the handle of FIG. 15.
FIG. 24 is a cross-sectional view along line 10—10 of the embodiment of the sheath of FIGS. 15 and 23.

As shown in FIGS. 18–24, the rotatable handle 112 comprises an inner core 114 and an outer rotatable sheath 116. The inner core 114 is cylindrical-like in shape as shown in FIGS. 21–22 and made of materials, such as composites, which are well known in the tennis industry. The inner core may be integrally attached to the neck portion 113 or separately attached thereto and is also made of materials well known in the tennis industry. At the end 118 nearest the neck, the inner core comprises a single male member, such as spline 120. Spline 120 is contained by a plane parallel to the striking surface. The other end 122 of the inner core 114 is annular-like in shape and comprises a ridged outer surface having one or more ridges 124 which extend along the axis of the inner core 114 as shown in FIGS. 21–22. End 122 further from the neck comprises an inner surface comprising a threaded insert 126 as shown in FIG. 18.

The outer sheath 116 has a cylindrical-like inner surface 128 as shown in FIGS. 19 and 23–24 which enables the outer sheath 116 to be locked into position with respect to the inner core 114 upon rotation. At the end 130 further from the neck, there are one or more channels 132 which correspond to ridges 124 in a one-to-one manner as shown in FIGS. 23–24. As shown in FIG. 20, channels 132 are dimensioned so that ridges 124 snugly fit therein. The shape of channels 132 and ridges 124 may vary, ranging from being rectangular to being triangular. The same can be said for indentations 136 and male member 120.

At the end 134 nearest the neck, the inner surface 128 comprises one or more indentations 136. Indentations 136 have a shape such that spline 120 snugly fits therein as shown in FIG. 19. The indentations 136 are positioned along the circumference of the inner surface 128 so as to correspond in a one-to-one manner with predetermined acute angles ($\theta$) between the plane 14 of the striking surface and a second plane 16 defined by the plane of symmetry for the prism-shaped handle as described regarding FIGS. 13 and 24. The outer sheath 116 further has an outer surface 138 in the shape of a polygon, such as a regular hexagon.

The handle is constructed by inserting the inner core 114 into the outer sheath 116 as shown in FIG. 18. The outer sheath 116 is rotated with respect to the inner core 114 to a predetermined position. The amount of rotation of the outer sheath 116 is controlled by rotating the outer sheath 116 until a desired indentation 136 is aligned with the spline 120 on the inner core 114. Then the outer sheath 116 is pushed toward the neck until the desired indentation 136 engages spline 120 as shown in FIG. 19. As indentation 136 engages spline 120, ridges 120 engage channels 132 so that outer sheath 116 is fixed in position with respect to the inner core 114. Once a desired angular position is achieved to correct for misalignment of a player's grip, a locking element, such as a locking screw 140 is inserted through the hole and channel of the outer sheath 116 and screwed into the threaded insert of the inner core 114 to lock the outer sheath 116 with respect to the inner core 114.

Outer sheath 116 has an annular ring 142 having a plurality of evenly spaced markings or graduations 144 encircling the annular ring 142. Furthermore, secondary markings 146, such as the numerals 0–9, are placed adjacent to those markings 144 which lie directly above indentations 136. Similarly, a marking 148 is located on the inner core 114 which represents the angular position of spline 120 on the inner core 114. Thus, if it is determined that a player will achieve proper alignment with the outer sheath 116 rotated to the "5" position, one would locate the "5" secondary marking and align it with marking 148 as the outer sheath 116 is inserted over the inner core 114. This alignment procedure insures that spline 120 will be inserted in indentation 136 which lies below the "5" marking. Once the outer sheath 116 is aligned and fully inserted over inner core 114, the outer sheath is locked into position by a locking screw 140.

Once the handle's position has been locked into position by the locking screw 140, the rotatable handle 112 has a shape and orientation which is best described such that when two parallel planes, which are perpendicular to the planar striking surface, intersect the handle in a manner shown in FIGS. 12A, 12B, and 13, the planes and the outer surface of the handle define a volume of space in the shape of a prism which comprises a polygonal base and a plurality of surfaces. Thus, when the handle is rotated to a predetermined position indicated by a secondary marking 146, the prism is asymmetric with respect to a first plane defined by the planar striking surface. Furthermore, the polygonal base is in the shape of a polygon, such as a regular hexagon, having two parallel sides which intersect and are perpendicular to a second plane. The polygon may have two parallel sides which are bisected by the second plane.

The predetermined positions represented by the secondary markings 146 are chosen such that the first plane and second plane intersect each other at an acute angles ranging from greater than 0° to approximately 40° or from greater than 0° to approximately 30° or from greater than 0° to approximately 10° or from greater than 0° to approximately 5°. For example in the embodiment of FIGS. 15–24 secondary markings 0–9 are present which represent acute angles 30°, 24°, 18°, 12°, 6°, 0°, −6°, −12°, −18°, and −24°, wherein a negative angle denotes the planar striking surface is rotated counterclockwise with respect to the plane of symmetry. Note that the "0" secondary marking also represents an acute angle of −30°. It is projected that the positions represented by secondary markings 0, 1, 2, 3 would be utilized by approximately 7% of the general population. Positions represented by secondary markings 4 and 5 would be utilized by approximately 17% of the general population. Similarly, positions represented by secondary markings 6–9 would be utilized by approximately 24%, 23%, 17%, and 12%, respectively, by the general population.

It is understood a particular player's ideal angular position may fall in between 6° intervals between the angular positions of 30°, 24°, 18°, 12°, 6°, 0°, −6°, 12°, −18°, and −24°. In these situations, separate outer sheaths having indentations 136 located at other angular positions are produced to cover angles in the 6° intervals. For example, one outer sheath having indentations 136 located at approximately 31°, 25°, 19°, 13°, 7°, 1°, −1°, −7°, −13°, −19°, −25°, and −31° may be produced. Another sheath would be produced having indentations 136 located at approximately 32°, 26°, 20°, 14°, 8°, 2°, −2°, −8°, −14°, −20°, −26°, and −32°. Other sheaths would be produced in a similar manner so that all of the angular possibilities are covered.

In another embodiment of the invention, outer sheath 116 is freely rotatable about inner core 114 when outer sheath 116 is placed over the inner core 114. A player knowing the angle to correct misalignment would rotate the outer sheath until a marking 144, 146 representing the desired angle is aligned with marker 148. The outer sheath 116 is then locked into position with respect to the inner core 114 by a locking mechanism such as locking screw 134. Note that in this embodiment the plurality of markings 144 and secondary markings 146 of the outer sheath 116 may be placed on the inner core 114 and the marker 148 of the inner core 114 may be placed on the outer sheath 116 without departing from the spirit of the invention. Once a desired angular position is achieved to correct for misalignment of a player's grip, a locking element, such as a locking screw 140 is inserted through the hole and channel of the outer sheath 116 and screwed into the threaded insert of the inner core 114. Note that the plurality of markings 130 of the outer sheath 116 may be placed on the inner core 114 and the marker 118 of the inner core 114 may be placed on the outer sheath 116 without departing from the spirit of the invention.

In both embodiments of the present invention, once the handle's position has been locked into position by the locking screw 134, the rotatable handle 112 has a shape and orientation which is best described such that when two parallel planes, which are perpendicular to the planar striking surface, intersect the handle in a manner shown in FIGS. 12A, 12B, and 13, the planes and the outer surface of the handle define a volume of space in the shape of a prism which comprises a polygonal base and a plurality of surfaces. Thus, when the handle is rotated to a predetermined position indicated by a marking 130, the prism is asymmetric with respect to a first plane defined by the planar striking surface. Furthermore, the polygonal base is in the shape of a polygon, such as a regular hexagon, having two parallel sides which intersect and are perpendicular to a second plane. The polygon may have two parallel sides which are bisected by the second plane. The predetermined positions are chosen such that the first plane and second plane intersect each other at an acute angles ranging from greater than 0° to approximately 40° or from greater than 0° to approximately 30° or from greater than 0° to approximately 10° or from greater than 0° to approximately 5°. For example, the acute angles may be 0°, 6°, 12°, 18°, 24°, and 30°.

It should be noted that though FIGS. 15–24 disclose a male member 120 on the inner core and indentations 136 in the outer sheath, it is contemplated that they could be interchanged without departing from the spirit of the invention. The same situation is present for ridges 124 and channels 132. It is further contemplated to use the molded handle of FIG. 14C for handle 112. The molded handle would be oriented such that a first plane parallel to or defined by the planar striking surface of the racket was at a predetermined angle with respect to a second plane bisecting the "V" formed between the thumb and fingers properly positioned in the molding. The predetermined positions would be the same as disclosed for the embodiment of FIGS. 15–24.

I claim:

1. A racket, comprising:

a substantially planar striking surface;

a neck having one end connected to said substantially planar striking surface; and a handle connected to another end of said neck, said handle has a shape such that when two parallel planes, which are perpendicular to the planar striking surface, intersect the handle, the planes and the handle define a prism which comprises a polygonal base and a plurality of surfaces;

said handle is rotatable about an axis to one or more predetermined positions, wherein when said handle is rotated to said one or more predetermined positions said prism is asymmetric with respect to a first plane parallel to said planar striking surface;

an outer sheath and an inner core inserted into said outer sheath, wherein said inner core comprises a male member and said outer sheath comprising one or more indentations, wherein one of said one or more indentations engages said male member when said inner core is inserted into said outer sheath.

2. The racket of claim 1, wherein said one or more indentations correspond to said one or more predetermined positions and said prism is asymmetric with respect to a first plane parallel to said planar striking surface.

3. The racket of claim 2, wherein said inner core comprises a first marker indicating the position of said male member; and said outer sheath comprises one or more secondary markers indicating the positions of said one or more indentations, wherein a predetermined position is achieved when said first marker is aligned with one of said secondary markers.

4. The racket of claim 1, wherein said one or more indentations correspond in a one-to-one manner to said one or more predetermined positions and said prism is asymmetric with respect to a first plane parallel to said planar striking surface.

5. The racket of claim 1, wherein said inner core comprises a first marker indicating the position of said male member; and said outer sheath comprises one or more secondary markers indicating the positions of said one or more indentations, wherein a predetermined position is achieved when said first marker is aligned with one of said secondary markers.

6. A racket, comprising:

a substantially planar striking surface;

a neck having one end connected to said substantially planar striking surface; and a handle connected to another end of said neck, said handle has a shape such that when two parallel planes, which are perpendicular to the planar striking surface intersect the handle, the planes and the handle define a prism which comprises a polygonal base and a plurality of surfaces;

said handle is rotatable about an axis to one or more predetermined positions, wherein when said handle is rotated to said one or more predetermined positions said prism is asymmetric with respect to a first plane parallel to said planar striking surface;

an outer sheath and an inner core inserted into said outer sheath, said outer sheath is freely rotatable about said inner core when said inner core is inserted into said outer sheath wherein said inner core comprises a first marker; and said outer sheath comprises one or more secondary markers, wherein a predetermined position is achieved when said first marker is aligned with one of said secondary markers.

* * * * *

UNITED STATES PATENT AND TRADEMARK OFFICE

CERTIFICATE OF CORRECTION

PATENT NO. : 5,409,216
DATED : April 25, 1995
INVENTOR(S) : Andrew J. Brown

It is certified that error appears in the above-indentified patent and that said Letters Patent is hereby corrected as shown below:

On the Title Page item [22] delete "Filed: Mar. 1, 1992" and substitute --Filed: Mar. 1, 1993--.

In the Claims

Column 14,
In claim 6, line 8, after "surface" insert --,--.
Column 14,
In claim 6, line 19, after "sheath" insert --,--.

Signed and Sealed this

Twenty-seventh Day of February, 1996

Bruce Lehman

*Attest:*

BRUCE LEHMAN

*Attesting Officer*

*Commissioner of Patents and Trademarks*